United States Patent [19]

Gange

[11] 4,100,449

[45] Jul. 11, 1978

[54] UNIFORM FILAMENT AND METHOD OF MAKING THE SAME

[75] Inventor: Robert Allen Gange, Belle Mead, N.J.

[73] Assignee: RCA Corporation, New York, N.Y.

[21] Appl. No.: 673,865

[22] Filed: Apr. 5, 1976

[51] Int. Cl.[2] ..... H01J 1/20; H01J 19/14

[52] U.S. Cl. ..... 313/337; 313/340; 313/357; 427/77

[58] Field of Search ..... 313/278, 340, 354, 357, 313/337; 427/77, 78

[56] References Cited

U.S. PATENT DOCUMENTS

| | | | |
|---|---|---|---|
| 1,719,988 | 7/1929 | Myers | 313/340 |
| 2,227,046 | 12/1940 | Waldschmidt | 313/340 |
| 2,321,439 | 6/1943 | Verwey et al. | 313/340 X |
| 2,489,367 | 11/1949 | Weyer | 313/278 X |
| 2,831,140 | 4/1958 | Blickwedel et al. | 313/340 |
| 3,936,532 | 2/1976 | Barofsky | 313/340 |

*Primary Examiner*—Saxfield Chatmon, Jr.
*Attorney, Agent, or Firm*—Eugene M. Whitacre; Donald S. Cohen; George E. Haas

[57] ABSTRACT

A line electron filament is provided which is cylindrically shaped and substantially uniform in cross section about its longitudinal axis. The filament can be of the type known as directly heated or of the type known as indirectly heated. The uniformity of the filament is obtained through cataphoretic deposition in a rotating cylindrical tube. The filament is useful as a cathode in a display which employs space charge limited emission operation.

22 Claims, 6 Drawing Figures

UNIFORM FILAMENT AND METHOD OF MAKING THE SAME

BACKGROUND OF THE INVENTION

This invention relates to electron filaments, and particularly to a line filament which is substantially uniform in cross section about its longitudinal axis.

Electron filaments are either directly heated or indirectly heated. A directly heated filament includes a refractory metal core, such as tungsten, which either functions as an electron emitter itself, or which is coated with an emissive material, such as emission carbonate. An indirectly heated filament, i.e., the emissive material is not directly heated, includes a heater element which is separated from an emissive material by a body of electrically insulating material.

Although there are numerous filaments which have been developed, none is suitable for use in a display in which a uniform line source of thermionic electrons is required. A line filament, i.e., a line source of thermionic electrons, would be particularly useful as the cathode in a flat image display device. However, for satisfactory emission uniformity, it is necessary that the line filament operate under space charge limited emission conditions. This means that the distance between the filament and the effective anode through which the electrons are collected must be accurately maintained. However, conventional filaments exhibit substantial non-uniformities in cross section and linearity along their length. These non-uniformities are primarily due to deposition techniques employed during construction. Even when put under high tensile stress, these non-uniformities and non-linearities are serious enough to cause appreciable variations in the filament to anode separation which make operation in a display device impractical. Therefore, it would be desirable to develop a line filament which is substantially uniform in cross section along its longitudinal axis.

SUMMARY OF THE INVENTION

An electron filament includes a cylindrical body of refractory metal. The body is substantially uniform in cross section about its longitudinal axis. A layer of emissive material is concentrically disposed on and around the cylindrical body and along the longitudinal axis thereof. The layer of emissive material is substantially uniform in thickness.

DETAILED DESCRIPTION OF THE INVENTION

Figure 1:
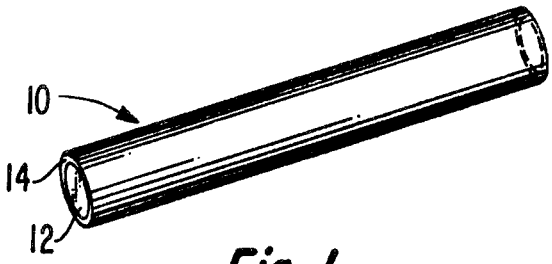
FIG. 1 is a perspective view showing one form of electron filament of the present invention.
Figure 2:
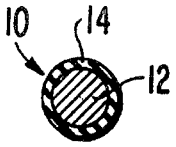
FIG. 2 is a cross-sectional view of the filament of FIG. 1.

Referring initially to FIGS. 1 and 2, a directly heated filament is generally designated as 10. The filament 10 includes a cylindrical body 12 of a refractory metal, such as tungsten. The tungsten body 12 has a diameter of about 250 microns and a length which is generally at least 100 times its diameter, with ratios of 1000 to 1 being typical. For most applications, the diameter of the tungsten body 12 is generally in the range of from about 10 to about 1000 microns. The cylindrical body 12 is cataphoretically coated with a layer 14 of an emission carbonate. The emission carbonate may comprise about 13% $CaCO_3$, 31% $SrCO_3$, and 56% $BaCO_3$. The layer 14 of emission carbonate is concentrically disposed on and around the tungsten body 12 and along the longitudinal axis thereof. The thickness of the emissive layer 14 is about 40 microns. For most applications, the thickness of the emissive layer 14 is between about 10 to about 100 microns.

The filament 10 is substantially uniform in cross section about its longitudinal axis. That is, variations in the diameter of the filament 10 are less than about 25 microns. This is in contrast to the much larger variations, e.g., often greater than 125 microns, found in filaments constructed through conventional deposition techniques. In addition, under high magnification, I have observed that filaments of the present invention are more uniform than those produced through conventional spray coating techniques.

Figure 3:
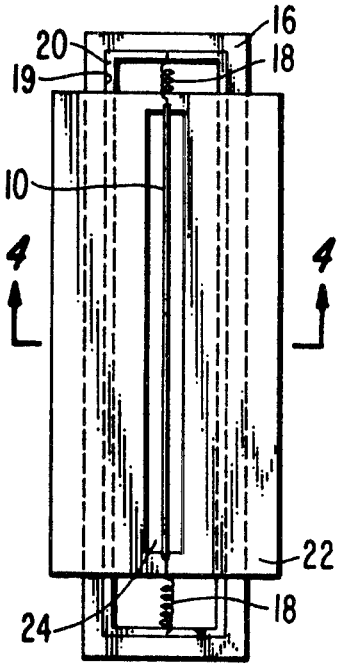
FIG. 3 is a plan view showing an embodiment of a cathode structure which utilizes the filament of FIG. 1.
Figure 4:
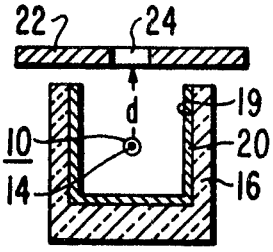
FIG. 4 is a sectional view taken along lines 4—4 of FIG. 3.

In one embodiment of a cathode structure, the filament 10 is centrally suspended in a 1mm × 1mm cavity cut in an electrically insulating substrate 16, such as quartz, as shown in FIGS. 3 and 4. Tension is applied to the filament 10 through springs 18. The springs 18 can be helical springs composed of 125 micron diameter Haines alloy No. 25 wire. The springs 18 are preset to a tension of 2.3 Kg thereby placing a tensile stress of 4.7 $\times 10^9$ dynes/cm$^2$ (67,800 psi) on the filament 10. This tensile stress is within the tensile strength of the 250 micron diameter tungsten body 12. The tensile stress applied is a function of the cavity in which the filament is suspended, the temperature at which the filament is operated, and the uniformity requirements imposed on the emission current. In every case, however, care must be taken so as not to surpass the tensile strength of the filament.

The inner walls 19 of the cavity in the substrate 16 are coated with a tantalum layer 20. The tantalum layer 20 has a thickness of about 3000Å. A nickel plated beryllium copper mask 22 containing an exit slit 24 is aligned over the cavity. The exit slit 24 functions as the effective anode through which the electrons are collected. Space charge limited emission operation requires, for purposes of uniformity, that the distance *d* between the outer surface of the emissive layer 14 (emissive surface) of the filament 10 and the exit slit 24 (effective anode) be substantially uniform along the length of the filament 10. As previously stated, and as shown in FIG. 2, the filament 10 is substantially uniform in cross section about its longitudinal axis along its operational or emitting length. Therefore, the distance *d* shown in FIG. 4 is substantially uniform along the operational or effective length of the filament, as desired.

Figure 5:
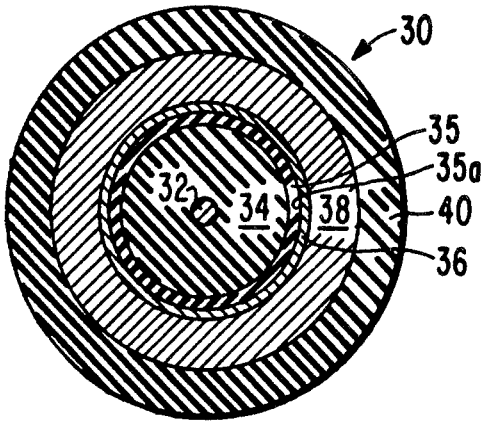
FIG. 5 is a cross-sectional view of another form of filament of the present invention.

Referring now to FIG. 5, another form of the filament of the present invention is shown and is designated 30. The filament 30 is an indirectly heated filament which meets the same requirements as the previously described filament 10. The filament 30 includes a cylindrical body 32 of a refractory metal, such as tungsten. For most applications, the tungsten body 32 has a diameter of about 10 to 100 microns, with about 25 microns being typical. An electrically insulating layer 34, e.g., an alumina quartz tunic, is concentrically disposed on and around the body 32. The alumina-quartz insulating layer 34 has a uniform thickness of about 75 microns. An outer electrically insulating layer 35, e.g., an overlay of 75% alumina and 25% tungsten, is concentrically disposed on and around the inner insulating layer 34. The outer insulating layer 35 has a uniform thickness of about 2.5 microns. The insulating layers 34 and 35 are, in effect, a body of insulating material which is concentrically disposed on and around the cylindrical body 32. A thin layer 36 of electrolessly deposited nickel, approximately 3000Å in thickness, is concentrically disposed on and around the outer insulating layer 35. A relatively thick layer 38 of electroplated nickel is disposed on the electroless nickel layer 36. The electroplated nickel layer 38 has a thickness of about 50 microns. A layer 40 of emission carbonate is disposed on and around the electroplated nickel layer 38. The layer 40 of emission carbonate has a thickness of about 37 microns.

The cross section of the indirectly heated filament 30 is substantially uniform along its operational or effective length. That is, variations in its diameter are less than about 25 microns. The filament 30 can be considered to be substantially uniform in cross section about its longitudinal axis since the diameter of the filament is typically about 330 microns. Consequently, the indirectly heated filament 30 is also particularly suitable for use as a uniform emission line source under space charge limited emission conditions, as in FIGS. 3 and 4.

It should be noted that, in the indirectly heated filament 30 of FIG. 5, the combination of the electrically insulating layers 34 and 35 functions to provide electrical insulation between the heater (body 32 of metal) and the cathode conductor (layers 36 and 38 of nickel). In addition, the combination of the insulating layers 34 and 35 transfers the heat from the heater (body 32) so as to ultimately heat the layer 40 of emissive material.

In the construction of the previously described filaments, care must be taken to begin with a cylindrical body, e.g., tungsten, which itself is substantially uniform in cross section about its longitudinal axis. This can be accomplished by carefully drawing the tungsten through a precision die. Conventional processing is suitable since these techniques produce non-uniformities in the cross section of the cylindrical body which are typically less than 10 microns. Then, it is essential that all subsequent depositions onto and around the initial cylindrical body be substantially uniform in thickness.

Figure 6:
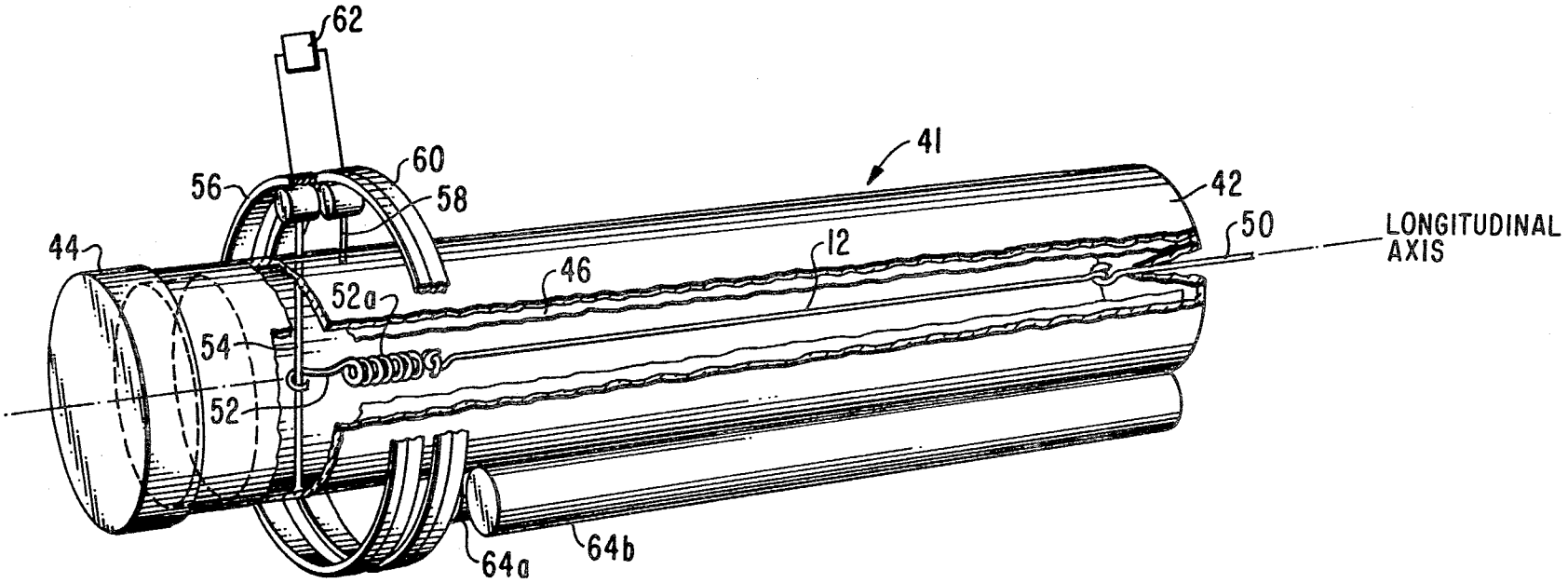
FIG. 6 is a partially broken away perspective view showing one form of apparatus suitable for carrying out the method of the present invention.

One apparatus 41 suitable for use in the construction of the previously described filaments is shown in FIG. 6. The apparatus 41 includes a cylindrical tube 42 of insulating material, e.g., quartz or pyrex, with a ground glass stopper 44 held at one end by any suitable means, e.g., rubber bands (not shown). The other end of the tube 42 is sealed. An electrically conductive body 46, e.g., a cylindrical nickel foil layer 46, is disposed along the inner circumference of the quartz tube 42. The nickel foil layer 46 entirely covers the inner circumference of the tube 42. The tube 42 typically has an inner radius of about 2 cm. The foil layer 46 should be of sufficient length so as to extend a distance beyond the ends of the particular body to be coated. This distance should be at least equal to the radius of the tube 42, preferably two or three times the radius.

The cylindrical body 12 to be coated is disposed with its major axis along the longitudinal axis of the tube 42 and placed under tension by a pair of hook feedthroughs 50 and 52. The hook feedthrough 50 extends through the sealed end and out of the tube 42. The hook feedthrough 52 includes a spring portion **52*a* which hooks onto a fixed electrical terminal 54. The fixed terminal 54 is disposed in orthogonal relation to the longitudinal axis of the tube 42. The terminal 54 extends beyond the circumference of the tube 42 so as to make electrical contact to a slip ring electrode 56 which lies outside the tube 42 and is concentric therewith. Another fixed terminal 58 (partially shown) is electrically connected to the cylindrical nickel foil layer 46 and extends beyond the circumference of the tube 42 so as to make electrical contact to a slip ring electrode 60. The slip ring electrodes 56 and 60 are electrically connected to a source 62** of electrical energy which can produce an output of up to about 300 volts at 20 mA.

Disposed outside of the tube 42 are a pair of rollers **64*a* and 64*b* (partially shown). The respective axes of the rollers 64*a* and 64*b* are in parallel relation to the longitudinal axis of the tube 42. The circumferences of the rollers 64*a* and 64*b* are each in abutting relation with the circumference of the tube 42. Thus, rotation of the rollers 64*a* and 64*b* about their respective longitudinal axes causes rotation of the tube 42 about its longitudinal axis. The rollers 64*a* and 64*b* are mechanically connected to a source which can rotate at a uniform rate (not shown). The source of rotation should be capable of causing the tube 42**, when filled, to rotate at constant rates of at least 80 rpm.

In the construction of the directly heated filament 10 of FIGS. 1 and 2, a carefully drawn cylindrical body 12 of tungsten is placed along the longitudinal axis of the tube 42 of FIG. 6 and maintained under tension therein so as to be in fixed relation to the tube 42. Preferably, the body 12 is fixed in relation to the tube 42 in the sense that neither can be moved or rotated separately, as shown in FIG. 6. The tension applied is generally of the order of magnitude applied during the operation of the filament. The tube 42 is then substantially filled with a suspension of the emission carbonate. The emission carbonate may consist of 13% $CaCO_3$, 31% $SrCO_3$, and 56% $BaCO_3$ in an electrolyte. The electrolyte may be ethyl methacrylate binder in acetone and calcium nitrate. The tube 42 is then rotated about its longitudinal axis at constant rates of about 80 rpm preferably for a period of at least 24 hours. During the rotation of the tube, its positioning is such that the force of gravity acts orthogonally to the longitudinal axis of the tube. This ensures a substantially uniform distribution of the cataphoretic suspension in the tube along the length of the body 12.

Then, while continuing to rotate the tube 42, an electrical field is provided across the tungsten body 12 and the nickel foil layer 46 through the source 62 and the slip ring electrodes 56 and 60, respectively. The electric field provided is such so as to cause the nickel foil layer 46 to function as an anode and the cylindrical body 12 to function as a cathode. This electrical field creates an electrostatic attraction which causes emission carbonate material in the suspension to cataphoretically deposit on and around the cylindrical body 12 which is held at ground potential. Cataphoretic deposition of the emission carbonate would also occur if the electrical field were reversed. However, I believe the result would be a weaker bond of the emission carbonate to the cylindrical body 12. Thus, it is preferable to cataphoretically deposit the emission carbonate onto a cylindrical body which functions as a cathode. The thickness of the emission carbonate deposit on and along the tungsten body 12 is controlled by the duration and magnitude of the applied voltage. By way of example, I have found that 175 volts across the 2cm tube radius for 7 seconds typically results in a cataphoretic deposition of about 25 microns in thickness. Field gradients within the tube of from about 50 volt/cm to about 150 volt/cm are typical, with about 88 volt/cm being preferred.

The deposition of the emissive material obtained through this method is extremely uniform in thickness. The uniformity is due to the homogeneous composition of the emission carbonate suspension during the cataphoretic deposition. This is made possible by the continuous rotation of the tube 42 both before and during the cataphoretic deposition. Also, the uniformity is made possible by the radial symmetry of the electric field distribution which results from axially disposing the cylindrical body 12 within the nickel foil layer 46. With this geometry, the nickel foil layer 46 (anode) completely surrounds the body 12 so that the body has a substantially constant number of electrical field lines per unit surface area along the surface of the cylindrical body 12. This ensures uniformity of deposition so as to result in a deposited layer of substantially uniform thickness. Furthermore, in this method, air gaps within the tube 42 are held to a minimum so that alteration of the electric field strength due to polarization differences between regions with and without air gaps are avoided. Also, since the body 12 rotates with the tube, differences due to residual air gaps tend to average out over the deposition time. In addition, uniform polarization of the emission carbonate suspension about the cylindrical axis is ensured by the uniform homogenization of the suspension due to continuous rotation of the tube 42.

In the construction of the indirectly heated filament 30 of FIG. 5, the previously described method must be modified. That is, the step of providing a cylindrical body which is substantially uniform in cross section about its longitudinal axis and the step of depositing a substantially uniform emissive layer must still be performed. However, other steps are necessary in order to provide the body of insulating material which is disposed between the refractory metal core and the emissive layer. These steps must also produce depositions which are substantially uniform in thickness so that the resultant filament will be substantially cylindrical and substantially uniform in cross section about its longitudinal axis.

In order to construct the indirectly heated filament 30 of FIG. 5, the cylindrical body 32 of tungsten, e.g. 25 microns in diameter, is placed in the apparatus 41 of FIG. 6 where it is cataphoretically coated with the insulating layer 34 of alumina. The cataphoretic deposition is terminated when the insulating layer 34 attains a uniform thickness of 75 microns. The cataphoretic deposition of the insulating layer 34 is performed in substantially the same manner as the previously described emission carbonate cataphoretic deposition. However, in this case, the cataphoretic suspension includes alumina particles, e.g., a suspension of alumina powder in an electrolyte such as water, magnesium nitrate, and aluminum nitrate. The alumina particles (powder) typically are about 20 to 30 microns in diameter. Also, for this cataphoretic deposition, the voltage gradient employed is in the order of about 10 volts/cm. For example, 18 volts for 7 seconds will yield the desired layer 34 of alumina in a tube having an inner diameter of about 1.6 cm.

The now coated body 32 is removed from the apparatus 41, placed under tension, and fired in a furnace (not shown) in the presence of a dry hydrogen atmosphere at 1700° C. The coated and fired body 32 is maintained under tension, and cooled in a dry hydrogen cooling zone in the furnace in order to reduce the nitrates to oxides and to inhibit surface oxidation of the coated body 32. Then, the fired, alumina coated body 32 is placed back in a cataphoretic deposition apparatus similar to the apparatus 41 and cataphoretically coated with the insulating layer 35, e.g., an overlay of 75% alumina and 25% tungsten. The insulating layer 35 has a thickness of 2.5 microns. The purpose of the insulating layer 35 is to improve the adhesion of the subsequently deposited electroless nickel layer.

The cataphoretic deposition of the insulating layer 35 is accomplished by adding tungsten powder to the alumina suspension. To obtain the thinner insulating layer 35, the voltage gradient can be decreased and, if desired, the time can also be decreased.

The twice coated body 32 is then removed from the deposition apparatus and refired at 1700° C under the previously stated conditions. The purpose of the first firing is to keep the tungsten in the outer insulating layer 35 from migrating into the inner alumina insulating layer 34. If the tungsten does migrate into the alumina insulating layer 34, it is possible that undesirable electrical shorts will result, i.e., the outer surface of the coated body 32 will form electrical connections to the tungsten cylindrical body 32. This can occur when the completed structure is operated at cathode temperatures. As a result of the second firing, the outer surface **35*a* of the alumina-tungsten insulating layer 35 becomes substantially impregnable. Then, the twice coated and twice fired body 32 is immersed into a quartz solution, such as one designated as Cyton commercially available from Monsanto Company. This immersion substantially fills any surface pores which may exist along the alumina-tungsten outer insulating layer 35. These surface pores occur due to a disproportionate amount of tungsten near the surface. In addition, due to this immersion, some quartz migrates into the alumina insulating layer 34 so as to result in the alumina-quartz insulating layer 34** described earlier.

Then the thin nickel layer 36, e.g., having a thickness of 3000Å, is electrolessly deposited at room temperature on and around the coated body 32. The electroless deposition is extremely important as it provides a conductive coating which is substantially uniform in thickness. Other desposition techniques introduce nonuniformities which are unsatisfactory. The electroless nickel solution should be one which includes nickel chloride; nickel sulfate; sodium hypophosphite; and a pH buffering or complexing compound. Particularly preferred is a solution which functions at room temperature, such as one commercially available from Surface Technology of Princeton, New Jersey under the designation Electroless Concentrate Part A and Part B. Further information concerning room temperature electroless nickel solutions can be found in U.S. Pat. No. 3,690,944 entitled, "Electroless Nickel Plating Method," issued Sept. 12, 1972 to N. Feldstein.

During the electroless plating, leakage of the electroless nickel bath into the insulating layers 34 and 35 at the end regions of the body 32 is eliminated by protecting these areas with a protective layer prior to immersion into the electroless nickel bath. For example, these areas can be coated with a laquer material, such as the one designated Microstop, which is commercially available from Michigan Chrome & Chemical Company of Detroit. When the electroless plating is complete, the protective layer is removed by a suitable solvent, e.g., acetone. Undesirable electrolytic plating of the electroless nickel through portions of the insulating layers 34 and 35 which may occur during filament operation is minimized by placing the electrolessly plated body 32 into a dry hydrogen atmosphere under tension at a temperature of 800° C for a time period of 10 minutes. This allows hydrogen to percolate through the plated body so as to remove oxidized elements which could cause detrimental electrolytic plating action of residual molecules during cathode operation.

Then, the thicker, e.g., 50 microns, nickel layer 38 is electroplated on the thin electrolessly plated nickel layer 36. The thin nickel layer 36 functions as the conductor base during the electroplating of the nickel layer 38. The electroplated body 32 is also placed under tension in a dry hydrogen atmosphere at 800° C for about 10 minutes. Then the emissive layer 40 is deposited concentrically on and around the nickel layer 38. The emissive layer 40 is also deposited using an apparatus similar to the apparatus 41 of FIG. 6. During this cataphoretic deposition, the nickel layers 36 and 38 function as the equivalent of the cylindrical body 12 of FIGS. 1 and 2, i.e., as the cathode. This can be accomplished by electrically connecting the nickel layers 36 and 38 to the spring 52*a* (not shown). In other respects, the cataphoretic deposition of the layer 40 of emissive carbonate is performed in substantially the same manner as earlier described for the directly heated filament 10.

Although the method of the present invention has been described with a separate cataphoretic deposition apparatus for several depositions, it is permissible to use a single cataphoretic deposition apparatus for all of the depositions. However, this requires cleaning the apparatus thoroughly before each deposition. This can be accomplished through the use of a cleaning solvent such as acetone. However, since impurities can interfere with the emission properties of the filaments of the present invention, it is preferable to use a separate apparatus for each of the different materials which are deposited. Also, for some applications, it may be acceptable if the cylindrical body to be coated is in fixed relation to the tube in the sense that it is axially located therein but capable of separate rotation. For example, the tube could include bearings in contact with the body to be coated such that the tube would be capable of separate rotation about the body to be coated (not shown).

Although the filaments of the present invention have been described with particular exemplary materials, many substitutions can be made. Other refractory metals for the heater element for both directly and indirectly heated filaments include molybdenum and cobalt, and alloys thereof. Suitable emissive materials include: coprecipitated single crystal $(BaSrCa)CO_3$ in the ratio 57/39/4 weight percent; $(BaSr)CO_3$ in the ratio 58/42 weight percent; and $BaCO_3$ and $SrCO_3$, either separately or mixed. Suitable insulating materials for the indirectly heated filament include those which are thermally stable and which have a surface chemistry which permits adherence to metals, such as zircon.

It should be noted that, although the indirectly heated filament has heretofore been described as having a pair of insulating layers, it is only necessary that the filament include an insulating layer disposed between the heater and the cathode conductor. For example, in some instances, it may be permissible to omit the outer insulating layer (layer 35 of FIG. 5). In such a case, the inner insulating layer (layer 34 of FIG. 5) functions as the necessary body of electrically insulating material. Similarly, layer 35 of FIG. 5 need not be electrically insulating since this function is already provided by the inner insulating layer (layer 34 of FIG. 5).

In addition, although the electron filaments of the present invention have been described as having particular dimensions, modifications can be freely made to satisfy a particular application. The uniformity of the filaments of the present invention is not limited to filaments of particular dimensions. However, the uniformity is most pronounced when referring to relatively small diameter filaments.

I claim:

1. An electron filament, which comprises:

a cylindrical body of refractory metal, said body being substantially uniform in cross section about its longitudinal axis, and a layer of emissive material concentrically disposed on and around said cylindrical body and along the longitudinal axis thereof with said layer being substantially uniform in thickness.

2. A filament in accordance with claim 1 in which the ratio of the length to diameter of said filament is at least 100 to 1.

3. A filament in accordance with claim 1 in which said filament has a diameter which varies by less than about 25 microns along the length of said filament.

4. A filament in accordance with claim 3 in which said refractory metal comprises tungsten.

5. A filament in accordance with claim 4 in which said emissive material comprises emission carbonate.

6. A filament in accordance with claim 1, which further comprises:

(a) a body of insulating material concentrically disposed on and around said cylindrical body and along the longitudinal axis thereof with said body of insulating material being disposed between said cylindrical body and said layer of emissive material, said body of insulating material being substantially uniform in thickness, (b) a first layer of electrolessly deposited metal concentrically disposed on and around said body of insulating material, and (c) a second layer of electroplated metal concentrically disposed on and around said layer of electrolessly deposited metal.

7. A filament in accordance with claim 6 in which said filament has a diameter which varies by less than about 25 microns along the length of said filament.

8. A filament in accordance with claim 7 in which said first and second metal layers comprise nickel.

9. A method of making an electron filament, which comprises:

(a) placing a cylindrical body of refractory metal into a cylindrical tube with said cylindrical body being disposed with its major axis along the longitudinal axis of said tube and maintained under tension in fixed relation to said tube, said tube including an electrically conductive body on and along its inner circumference, said tube being substantially filled with a suspension of emissive material, (b) rotating said tube about its longitudinal axis at a substantially constant rate with said tube being oriented such that the force of gravity acts orthogonally to the longitudinal axis of said tube, and then (c) establishing an electrical field between said cylindrical body and said electrically conductive body on said inner circumference so as to cataphoretically deposit a layer of said emissive material on and around said cylindrical body while rotating said tube, said layer of emissive material being substantially uniform in thickness.

10. A method in accordance with claim 9 in which said refractory metal comprises tungsten.

11. A method in accordance with claim 10 in which said emissive material comprises emission carbonate.

12. A method in accordance with claim 11 in which step (b) includes rotating said tube for at least 24 hours before performing step (c).

13. A method in accordance with claim 11 in which said electrical field established in step (c) is of a direction so as to cause said cylindrical body to function as a cathode and said conductive body on said inner circumference to function as an anode.

14. A method in accordance with claim 11 in which said electrical field established in step (c) is of a magnitude so as to establish an electrical field gradient within said tube which is in the range of about 50 to about 150 volt/cm.

15. A method of making an electron filament, which comprises:

(a) placing a cylindrical body of refractory metal into a cylindrical tube with said cylindrical body being disposed with its major axis along the longitudinal axis of the tube and maintained under tension in fixed relation to said tube, said tube including an electrically conductive body on and along its inner circumference, said tube being substantially filled with a suspension of insulating material to be deposited, (b) rotating said tube about its longitudinal axis at a substantially constant rate with said tube being oriented such that the force of gravity acts orthogonally to the longitudinal axis of said tube, then (c) establishing an electrical field between said cylindrical body and said electrically conductive body so as to cataphoretically deposit a body of said material on and around said cylindrical body while rotating said tube, said body of insulating material being substantially uniform in thickness, (d) removing said cylindrical body from said tube, then (e) electrolessly plating a first metal layer on and around said body of insulating material, (f) electroplating a second metal layer on and around said first metal layer, said second metal layer being thicker than said first layer, and then (g) repeating steps (a), (b) and (c) but with said material to be deposited being an emission carbonate so as to cataphoretically deposit a layer of emissive material on and around said second metal layer, said layer of emissive material being substantially uniform in thickness.

16. A method in accordance with claim 15 in which said refractory metal comprises tungsten.

17. A method in accordance with claim 15 in which said emissive material comprises emission carbonate.

18. A method in accordance with claim 15 in which step (b) includes rotating said tube for at least 24 hours.

19. A method in accordance with claim 15 in which said electrical field during the cataphoretic deposition of said insulating material is of a magnitude so as to establish an electrical field gradient of about 10 volt/cm within said tube.

20. A method in accordance with claim 15 in which said electrical field during the cataphoretic deposition of said emissive material is of a magnitude so as to establish an electrical field gradient of about 50 to about 150 volt/cm within said tube.

21. An electron filament made by the method of claim 15.

22. An electron filament made by the method of claim 9.

* * * * *